US007636537B2

(12) United States Patent
Sano

(10) Patent No.: US 7,636,537 B2
(45) Date of Patent: Dec. 22, 2009

(54) POWDER SUPPLYING DEVICE AND IMAGE FORMING DEVICE HAVING A GAS BLOWING PART ARRANGED TO ENTIRELY COVER A BOTTOM SURFACE OF A POWDER CONTAINER UNIT

(75) Inventor: Hiroshi Sano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 23 days.

(21) Appl. No.: 11/736,296

(22) Filed: Apr. 17, 2007

(65) Prior Publication Data

US 2007/0242983 A1 Oct. 18, 2007

(30) Foreign Application Priority Data

Apr. 18, 2006 (JP) ..... 2006-114726

(51) Int. Cl.
*G03G 15/08* (2006.01)

(52) U.S. Cl. ..... 399/258

(58) Field of Classification Search ..... 399/258, 399/260, 262, 261, 263
See application file for complete search history.

(56) References Cited

U.S. PATENT DOCUMENTS

| | | | |
|---|---|---|---|
| 5,074,342 | A | 12/1991 | Kraehn |
| 5,950,055 | A | 9/1999 | Yahata et al. |
| 5,950,062 | A | 9/1999 | Yahata et al. |
| 6,201,941 | B1 | 3/2001 | Kasahara et al. |
| 6,393,241 | B1 | 5/2002 | Matsumoto et al. |
| 6,501,913 | B2 | 12/2002 | Hattori et al. |
| 6,577,842 | B2 | 6/2003 | Akiba et al. |
| 6,591,077 | B2 | 7/2003 | Yanagisawa et al. |
| 6,628,908 | B2 | 9/2003 | Matsumoto et al. |
| 6,648,029 | B1 | 11/2003 | Amano |
| 6,665,508 | B2 | 12/2003 | Sudo et al. |
| 6,679,301 | B2 | 1/2004 | Makino et al. |
| 6,775,503 | B2 | 8/2004 | Hattori et al. |
| 6,826,381 | B2 | 11/2004 | Muramatsu et al. |
| 6,859,634 | B2 | 2/2005 | Itoh et al. |
| 6,863,096 | B2 | 3/2005 | Amano |

(Continued)

FOREIGN PATENT DOCUMENTS

DE 100 44 219 A1 5/2002

(Continued)

OTHER PUBLICATIONS

U.S. Appl. No. 10/549,918, filed Dec. 4, 2006, Hirosato Amano.

(Continued)

*Primary Examiner*—Quana M Grainger
(74) *Attorney, Agent, or Firm*—Oblon, Spivak, McClelland, Maier & Neustadt, L.L.P.

(57) ABSTRACT

In a powder supplying device which supplies powder to a powder receiving device, a powder container unit contains powder therein and is provided at a bottom of the powder container unit with a gas blowing part which blows gas to the inside of the powder container unit. A suction tube has a suction opening and attracts powder contained in the powder container unit from the suction opening. A powder transporting unit transports powder attracted by the suction tube, to the powder receiving device. The suction tube is arranged in a vicinity of a side wall of the powder container unit.

17 Claims, 10 Drawing Sheets

U.S. PATENT DOCUMENTS

| | | | |
|---|---|---|---|
| 6,874,546 | B2 | 4/2005 | Amano et al. |
| 6,981,530 | B2 | 1/2006 | Amano et al. |
| 7,017,625 | B2 | 3/2006 | Amano et al. |
| 2005/0244193 | A1 | 11/2005 | Amano et al. |
| 2006/0024101 | A1 | 2/2006 | Schoch et al. |

FOREIGN PATENT DOCUMENTS

| | | | | |
|---|---|---|---|---|
| EP | 0 878 240 | A2 | | 11/1998 |
| JP | 4-34480 | | | 2/1992 |
| JP | 11-212348 | | | 8/1999 |
| JP | 2000-19830 | | | 1/2000 |
| JP | 2000267413 | A | * | 9/2000 |
| JP | 2001-175070 | | | 6/2001 |
| JP | 2002-293301 | | | 10/2002 |
| JP | 2005-24622 | | | 1/2005 |
| JP | 2005-215655 | | | 8/2005 |
| JP | 2005-292300 | | | 10/2005 |
| JP | 2006-47972 | | | 2/2006 |
| JP | 2006-48009 | | | 2/2006 |
| JP | 2006-48010 | | | 2/2006 |

OTHER PUBLICATIONS

U.S. Appl. No. 11/679,949, filed Feb. 28, 2007, Hiroshi Sano, et al.
U.S. Appl. No. 11/679,964, filed Feb. 28, 2007, Hiroshi Sano, et al.
U.S. Appl. No. 12/018,611, filed Jan. 23, 2008, Sano.
U.S. Appl. No. 11/911,598, filed Oct. 15, 2007, Sano et al.

* cited by examiner

POWDER SUPPLYING DEVICE AND IMAGE FORMING DEVICE HAVING A GAS BLOWING PART ARRANGED TO ENTIRELY COVER A BOTTOM SURFACE OF A POWDER CONTAINER UNIT

BACKGROUND OF THE INVENTION

1. Field of the Invention

This invention relates to a powder supplying device which supplies powder, such as a toner, to a toner receiving device, and an image forming device including the powder supplying device and using the electrophotographic method, such as a copier, a printer, a facsimile, or a multi-function peripheral.

2. Description of the Related Art

Powder supplying devices containing a mass toner, such as toner banks and toner replenishing devices, for use in image forming devices, such as copiers or printers, are disclosed in some publications. For example, see Japanese Patent No. 3534159 and Japanese Laid-Open Patent Application No. 2005-024622.

Japanese Patent No. 3534159 discloses a powder supplying device (toner bank) in which a plurality of toner containers in the bottle-like shape are installed. Specifically, one of the plurality of toner containers is opened and the toner contained in the toner container is supplied to a toner hopper of the toner bank. The toner in the toner hopper is transported by a gas-flow transporting unit to a developing device which is a powder receiving device. And when the toner in the opened toner container becomes empty, another toner container among the plurality of toner containers is opened and toner replenishment is performed with the newly opened toner container.

Japanese Laid-Open Patent Application No. 2005-024622 discloses a toner replenishing device in which a toner hopper having a capacity much larger than the capacity of a toner container is provided. Specifically, the toner hopper is capable of containing an amount of toner equivalent to the amount of toner contained in a plurality of toner containers. A stirring member is installed in the toner hopper and the toner inside the toner hopper is agitated by the stirring member. And the toner in the toner hopper is discharged from the lower part of the toner hopper, and is transported by a fluid transporting unit to a developing device which is a powder receiving device.

Moreover, Japanese Patent No. 3549051 discloses a powder supplying device (powder filling apparatus) which is adapted for filling up a toner container unit (the powder container unit) with toner (powder). Specifically, air is introduced into the powder filling apparatus, and the air pressure in the powder filling apparatus is increased, so that the toner (powder) contained in the powder filling apparatus is discharged from a powder transport tube, and it is transported to a toner container which is a powder receiving device.

Since a plurality of toner containers are installed in the powder supplying device of Japanese Patent No. 3534159, transporting of a large amount of toner is attained. However, after all the toner contained in the plurality of toner containers becomes empty, the setting work of a number of new toner containers corresponding to the number of the used toner containers will arise. Therefore, there is the problem that the workability at the time of toner end does not improve even if transporting of a large amount of toner is attained.

The powder supplying device of Japanese Laid-Open Patent Application No. 2005-024622 uses a large-capacity toner hopper which is aimed at transporting of a large amount of toner. However, since the toner in the toner hopper is mechanically agitated by the stirring member in order to prevent bridge formation of the toner contained in the hopper, mechanical stress may arise in the toner. If mechanical stress arises in the toner, the additive agent included in the toner may be deviated in the toner surface or separated from the toner surface. Even if the toner is a new toner, the toner is in a deteriorated condition, which will cause the quality of image to be lowered.

Moreover, the powder supplying device of Japanese Laid-Open Patent Application No. 2005-024622 is provided so that toner is discharged from the lower part of the toner hopper. When the sealing performance near the exhaust opening is lowered, the amount of toner which scatters from the powder supplying device is increased.

The powder supplying device of Japanese Patent No. 3549051 is provided such that high pressure is applied to the container containing toner, so that the toner is discharged from the inside of the container. For this reason, it is necessary that the mechanical strength of the container is set to a sufficiently high level, so that the container may not be broken by the applied pressure.

Therefore, even if the powder supplying device of Japanese Patent No. 3549051 can be used as a manufacturing device which fills up a toner container with toner, it is difficult to use the same for supplying toner to a developing device in an image forming device. Moreover, if the method of discharging the toner from the inside of the container by applying high pressure to the container containing the toner is used, the amount of toner discharged is greatly varied according to the amount of toner remaining in the container. And it is difficult to adjust finely the amount of toner discharged. Therefore, even if the powder supplying device of Japanese Patent No. 3549051 can be used as a manufacturing device which fills up a toner container with toner, it is difficult to use the same for supplying toner to a developing device in an image forming device.

The above-mentioned problems are common in all the powder supplying devices, including a powder supplying device provided in an image forming device to supply toner, which require fine adjustment of the amount of powder supplied, without damaging the powder. And it is necessary for all those powder supplying devices to supply efficiently the powder contained in the powder container unit to the powder receiving device with a minimized waste.

SUMMARY OF THE INVENTION

According to one aspect of the invention, there is provided an improved powder supplying device in which the above-described problems are eliminated.

According to one aspect of the invention there is provided a powder supplying device which is adapted for performing fine adjustment of the amount of powder supplied, without damaging the powder, and for supplying efficiently the powder contained in the powder container unit to a powder receiving device with a minimized waste, without causing the scattering of the powder.

In an embodiment of the invention which solves or reduces one or more of the above-mentioned problems, there is provided a powder supplying device powder supplying device which supplies powder to a powder receiving device, the powder supplying device comprising: a powder container unit containing powder therein and provided at a bottom of the powder container unit with a gas blowing part blowing gas to the inside of the powder container unit; a suction tube having a suction opening and attracting powder contained in the powder container unit from the suction opening; and a powder transporting unit transporting powder attracted by the suction tube, to the powder receiving device, wherein the suction tube is arranged in a vicinity of a side wall of the powder container unit.

The above-mentioned powder supplying device may be configured so that the bottom of the powder container unit is formed into a sloping surface, and the suction opening of the suction tube is arranged above a lowest position of the sloping surface.

The above-mentioned powder supplying device may be configured so that the gas blowing part is provided so that a flow rate of gas per unit area in a vicinity of the lowest position of the sloping surface is larger than a flow rate of gas per unit area in other positions of the sloping surface than the lowest position.

The above-mentioned powder supplying device may be configured so that the powder supplying device further comprises a regulation part which prevents the powder contained in the powder container unit from being attracted from a side of the side wall of the powder container unit where the suction tube is arranged nearby.

The above-mentioned powder supplying device may be configured so that the suction opening of the suction tube is open toward the bottom of the powder container unit, and the regulation part is constituted by a plate-like member which is arranged to extend downward over a part of a circumference of the suction tube on a side of the side wall of the powder container unit.

The above-mentioned powder supplying device may be configured so that the powder container unit is provided with a detection unit which detects a remaining powder in the powder container unit, and the detection unit is arranged in an upper position to the suction opening and arranged on a side of the suction tube where the restriction part is not arranged.

The above-mentioned powder supplying device may be configured so that the powder supplying device further comprises a second air blowing part blowing air directly or indirectly to the suction opening of the suction tube.

The above-mentioned powder supplying device may be configured so that the second gas blowing part has a gas discharge opening which is made of a porous member.

The above-mentioned powder supplying device may be configured so that the powder transporting unit is provided with a pump which attracts powder contained in the powder container unit from the suction opening of the suction tube, and discharges the attracted powder to the toner receiving device.

The above-mentioned powder supplying device may be configured so that the pump is arranged in a position above the toner receiving device and the powder container unit.

The above-mentioned powder supplying device may be configured so that some or all of a powder suction path from the powder container unit to the pump, and some or all of a powder discharge path from the pump to the toner receiving device are constituted by a set of tubes.

The above-mentioned powder supplying device may be configured so that the gas blowing part has a gas discharge opening, and the gas discharge opening is made of a porous member.

The above-mentioned powder supplying device may be configured so that the gas blowing part is connected to an air pump which is arranged outside the powder container unit.

The above-mentioned powder supplying device may be configured so that the powder container unit is provided so that the powder container unit is attachable to and detachable from a body of the powder supplying device.

The above-mentioned powder supplying device may be configured so that the powder contained in the powder container unit is a toner.

The above-mentioned powder supplying device may be configured so that the powder contained in the powder container unit is a two-component developer consisting of a toner and a carrier.

In an embodiment of the invention which solves or reduces one or more of the above-mentioned problems, there is provided an image forming device in which a powder supplying device is provided to supply powder to a powder receiving device, the powder supplying device comprising: a powder container unit containing powder therein and provided at a bottom of the powder container unit with a gas blowing part blowing gas to the inside of the powder container unit; a suction tube having a suction opening and attracting powder contained in the powder container unit from the suction opening; and a powder transporting unit transporting powder attracted by the suction tube, to the powder receiving device, wherein the suction tube is arranged in a vicinity of a side wall of the powder container unit.

According to the embodiments of the powder supplying device and the image forming device of the invention, air is blown off from the bottom of the powder container unit by the gas blowing part, and the suction tube, disposed in the vicinity of the side wall of the powder container unit, is used to attract the powder and the attracted powder is transported to the powder receiving device. Therefore, it is possible to provide the powder supplying device and the image forming device which are adapted for performing fine adjustment of the amount of powder supplied without damaging the powder, and for supplying efficiently the powder contained in the powder container unit to a powder receiving device with a minimized waste without causing the scattering of the powder.

BRIEF DESCRIPTION OF THE DRAWINGS

Other objects, features and advantages of the present invention will be apparent from the following detailed description when reading in conjunction with the accompanying drawings.

DETAILED DESCRIPTION OF PREFERRED EMBODIMENTS

A description will be given of embodiments of the invention with reference to the accompanying drawings.

Figure 1:
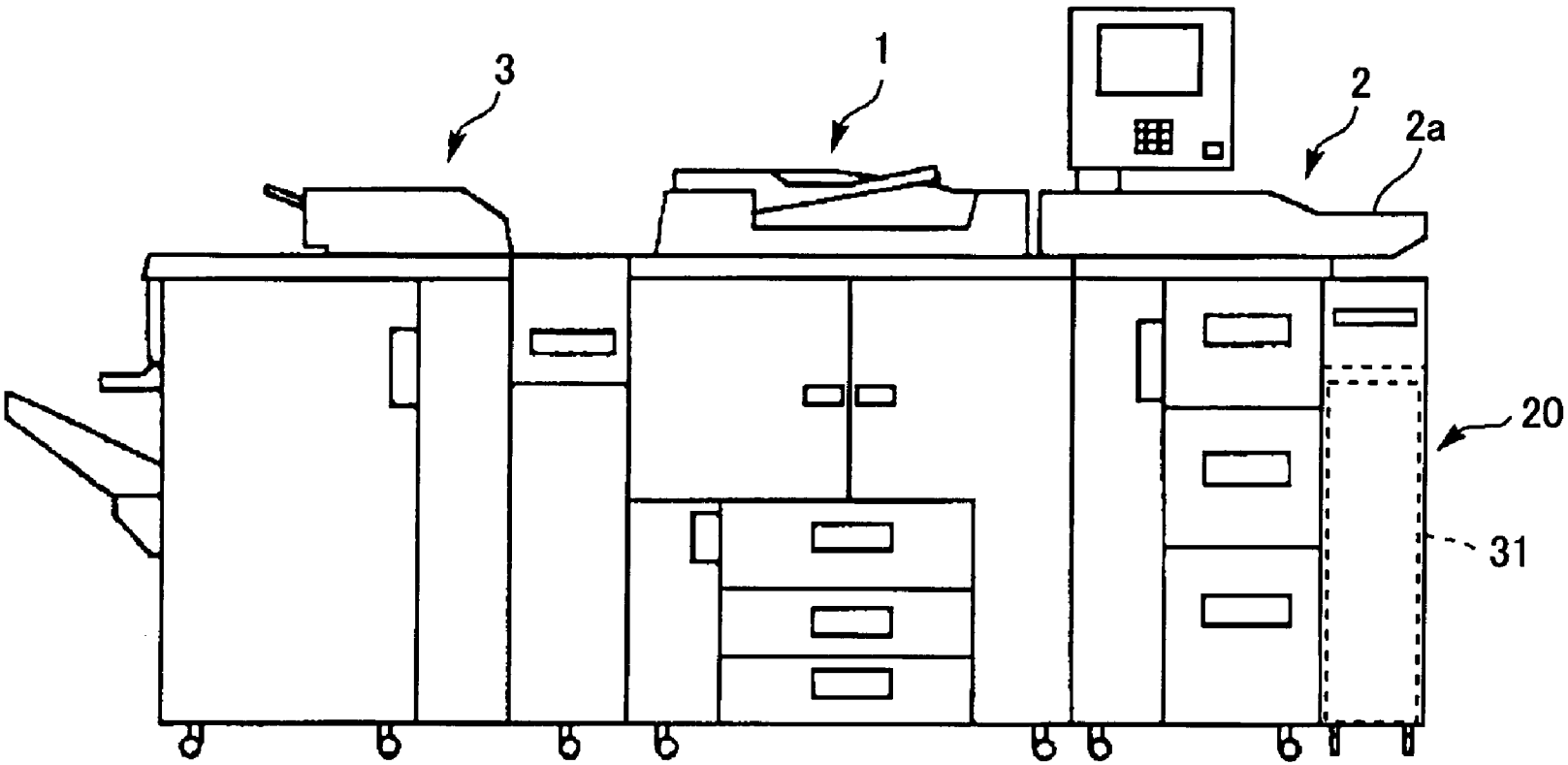
FIG. 1 is a diagram showing the outline composition of an image forming device in an embodiment of the invention.
Figure 2:
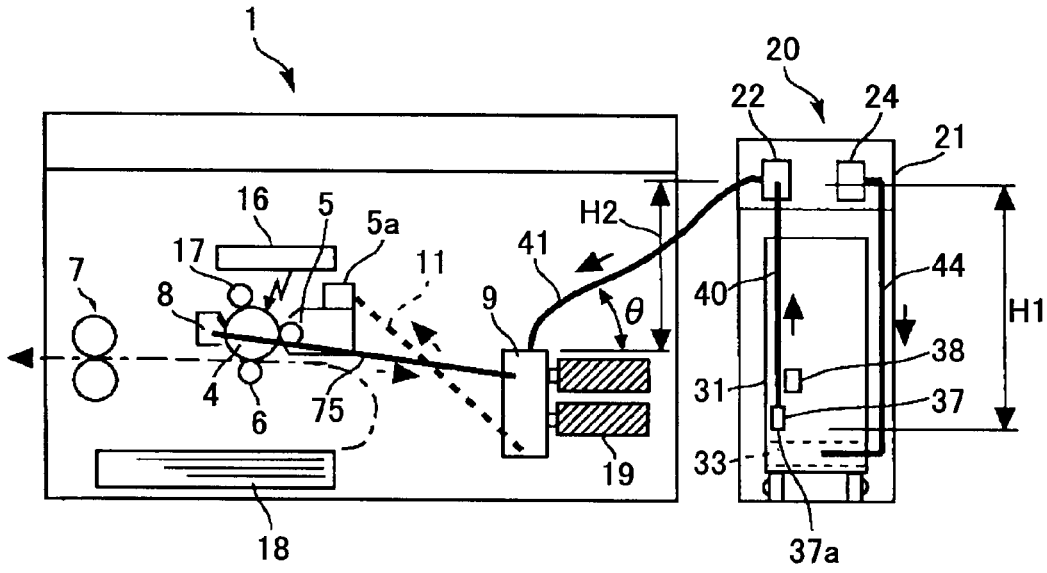
FIG. 2 is a diagram showing an image forming device body and a powder supplying device.

FIG. 1 shows the composition of an image forming device in an embodiment of the invention. FIG. 2 shows an image forming device body and a powder supplying device. In FIG. 1, reference numeral 1 denotes an image forming device body (copying unit) which forms a main part of an electrophotographic image forming device, reference numeral 2 denotes a mass feeding bank (sheet feeding unit), reference numeral 3 denotes a post-processing unit which performs sorting, stapler fixing, etc., and reference numeral 20 denotes a powder supplying device (toner supplying unit). The powder supply device 20 is installed under the wing 2*a* of the sheet supply tray arranged above the mass feeding bank 2.

In FIG. 2, reference numeral 1 denotes the image forming device body, reference numeral 4 denotes a photoconductor drum which is an image support, reference numeral 5 denotes a developing unit (developing device) which develops the electrostatic latent image formed on the photoconductor drum 4, reference numeral 6 denotes a transferring unit which transfers the toner image formed on the photoconductor drum 4 to a copy sheet (recording medium), reference numeral 7 denotes a fixing unit which fixes the non-fixed toner to the recording medium, reference numeral 8 denotes a cleaning unit which collects the non-transferred toner on the photoconductor drum 4, reference numeral 16 denotes an exposure unit which irradiates the exposing light to the photoconductor drum 4 based on the image information which is read by the document reading part, reference numeral 17 denotes a charging unit which charges the surface of the photoconductor drum 4, and reference numeral 18 denotes a sheet feeding unit in which a number of copy sheets (recording media) are contained.

Moreover, in FIG. 2, reference numeral 9 denotes a toner hopper which is a toner receiving device to which toner is supplied from the powder supplying device 20, reference numeral 11 denotes a toner transporting line through which the toner in the toner hopper 9 is transported to the toner replenishing part 5*a* of the developing unit 5, reference numeral 19 denotes a toner container (toner bottle) which is a second the powder container unit provided to supply the toner to the toner hopper 9 (toner receiving device) separately from the powder supplying device 20.

Moreover, in FIG. 2, reference numeral 75 denotes a toner supplying line (recycle path) through which the non-transferred toner, collected by the cleaning unit 8, is transported to the toner hopper 9 as a recycle toner. The toner supplying line 75 may be provided as being the path in which a transporting screw is installed, or may be provided as being the path in which a pump, such as a diaphragm type air pump, is installed.

As shown in FIG. 2, operation of the image forming device when usual image formation is performed will be explained.

By the transporting roller of the document transporting part, a document is transported from the document base and passed through the top of the document reading part. At this time, image information is optically read from the document, which passes through the top of the document reading part, by the document reading part. The image information optically read by the document reading part is converted into an electrical signal, and this electrical signal is transmitted to the exposure unit 16. The exposure unit 16 irradiates the exposing light, such as a laser beam, to the surface of the photoconductor drum 4 in accordance with the image information of the electrical signal received.

On the other hand, the photoconductor drum 4 is rotated in the clockwise rotation direction in FIG. 2. The surface of the photoconductor drum 4 is charged uniformly in the position opposed to the charging unit 17. And the surface of the photoconductor drum 4 charged by the charging unit 17 arrives at the irradiation position of the exposing light. An electrostatic latent image corresponding to the image information of the document is formed in this position on the photoconductor drum 4.

Thereafter, the surface of the photoconductor drum 4 on which the electrostatic latent image is formed reaches the position opposite to the developing unit 5. The latent image on the photoconductor drum 4 is developed by the developing unit 5. The toner in the developing unit 80 is mixed with a carrier by a paddle roller, together with the toner supplied from the toner replenishing part 5*a*. And the toner which is frictionally charged is supplied together with the carrier to the developing roller which counters the photoconductor drum 4.

The toner of the toner replenishing part 5*a* is suitably supplied to the developing unit 5 according to consumption of the toner in the developing unit 5. Therefore, the amount of consumption of the toner in the developing unit 5 is detected by the photo-sensor which counters the photoconductor drum 4, and by the permeability sensor provided in the developing unit 5.

The toner in the toner replenishing part 5*a* is suitably supplied from the toner hopper 9 via the toner transporting line 11 in which the toner transporting coil or the powder pump is provided. The toner in the toner hopper 9 is transported from the powder supplying device 20 arranged outside the image forming device body 1 by the transporting units 37, 40, 22, and 41.

The toner hopper in this embodiment is provided so that a plurality of toner containers 19 may be freely exchanged and installed in the toner hopper 9. And the toner from each toner container 19 may be supplied to the toner hopper 9. The toner container 19 may be used, when exchanging the powder container unit 31 of the powder supplying device 20, to supply toner to the toner hopper 9, which will prevent the inoperative condition from arising in the image forming device.

The toner container 19 in this embodiment is a bottle-type container, and a spiral projection is formed in the inside circumference of the toner container 19. When the toner container 19 is rotated, toner is ejected from the opening of the toner container 19 and the toner is supplied to the toner hopper 9.

Subsequently, the surface of the photoconductor drum 4 developed by the developing unit 5 reaches the position opposite to the transferring unit 6. The toner image on the photoconductor drum 4 is transferred to the recording medium at this position. At this time, the non-transferred toner which is not transferred to the recording medium remains on the photoconductor drum 4.

Subsequently, the surface of the photoconductor drum 4 containing the non-transferred toner passes through the transferring unit 6 and reaches the position opposite to the cleaning unit 8. The non-transferred toner is collected by the cleaning blade of the cleaning unit 8 which contacts the photoconductor drum 4, the non-transferred toner collected by the cleaning unit 8 is transported through the toner supplying line 75 to the toner hopper 9 as a recycle toner, and supplied to the developing unit 5 (the toner replenishing part 5*a*) together with the fresh toner supplied from the powder supplying device 20 or the toner container 19. This allows the image forming device to have a high recycling efficiency of toner.

Subsequently, the surface of the photoconductor drum 4 passes through the cleaning unit 8 and reaches the position of a charge eliminating unit (not shown). The electric potential of the surface of the photoconductor drum 4 is eliminated at this position, and the series of image forming processes are completed.

On the other hand, the recording medium transported by the transfer unit 6 operates as follows. One sheet feeding part is chosen by automatic or manual control from among the plurality of sheet feeding parts. Suppose that the sheet feeding part 18 is chosen. A sheet of recording medium contained in the sheet feeding part 18 is moved along the transporting line indicated by the one-dot chain line in FIG. 2.

Subsequently, the recording medium which is fed from the sheet feeding part 18 arrives at the position of the resist roller. The recording medium which arrived at the position of the resist roller doubles timing, in order to carry out the toner image and alignment which are formed on the photoconductor drum 4, and it is transported to the transferring unit 6.

The recording medium after the transfer process reaches the position of the fixing unit 7 through the transporting line, after passing through the position of the transferring unit 6. Heat and pressure are applied to the non-fixed toner image on the recording medium in this position.

Subsequently, the recording medium after the fixing process is ejected from the image forming device body as an output image, and the recording medium is subjected to the post-processing by the post-processing unit 3. In this way, a series of image formation processes are completed.

Figure 3:
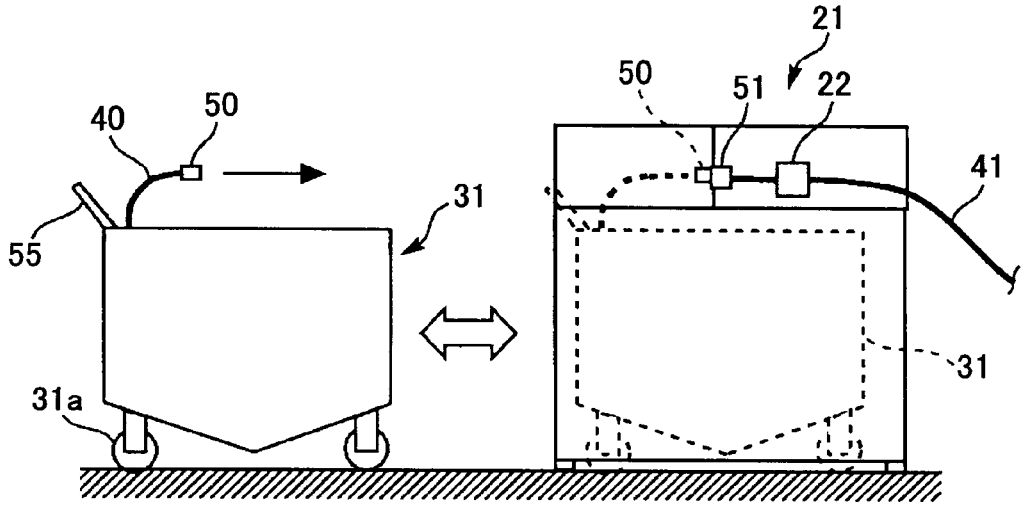
FIG. 3 is a diagram showing the condition in which the powder container unit is detached from or attached to the powder supplying device.
Figure 4:
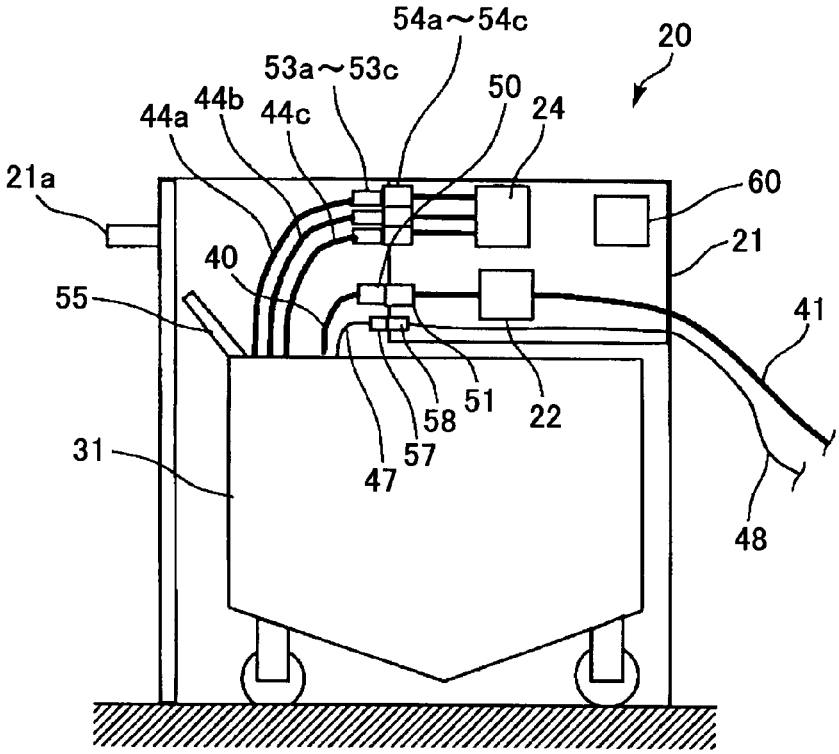
FIG. 4 is a diagram showing the composition of the powder supplying device.
Figure 5:
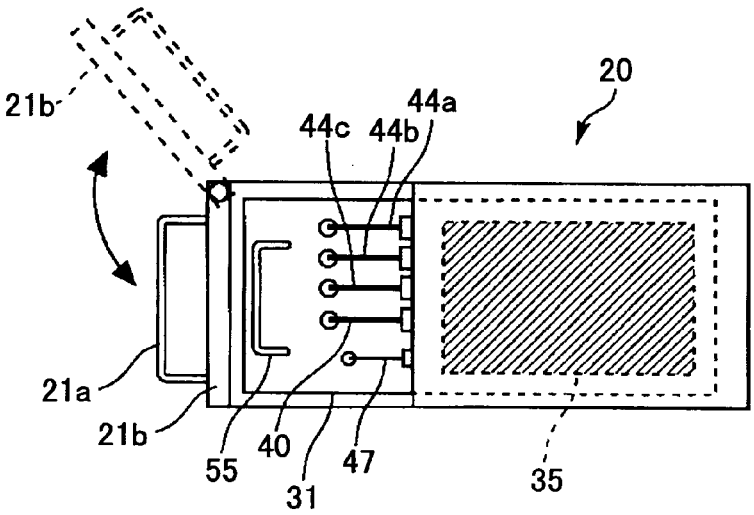
FIG. 5 is a top view of the powder supplying device.
Figure 6:
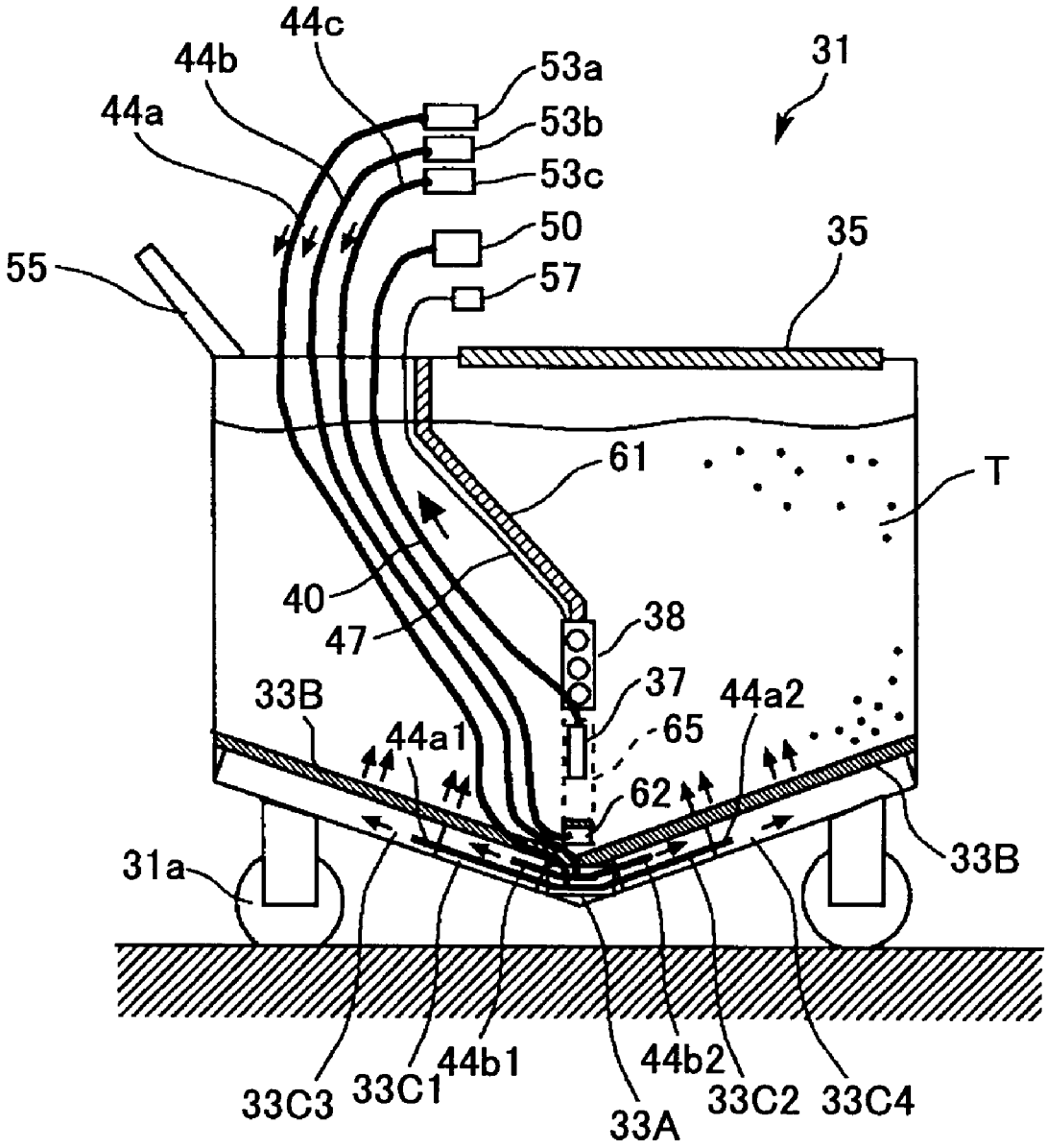
FIG. 6 is a diagram showing the composition of the powder container unit in the powder supplying device.

Next, the structure and operation of the powder supplying device 20 will be explained. FIG. 3 is a diagram showing the condition that a powder container is detached from a powder supplying device. FIG. 4 is a block diagram showing the composition of a powder supplying device in an embodiment of the invention. FIG. 5 is a top view of the powder supplying device shown in FIG. 4. FIG. 6 is a block diagram showing the powder container of the powder supplying device.

As shown in FIG. 2-FIG. 5, the powder supplying device 20 (toner supplying unit) includes a powder supplying device body 21 (fixed unit) fixed to the image forming device (mass sheet feeding bank 2), and a powder container unit 31 (toner tank unit) which contains toner (powder) therein.

As shown in FIG. 3, the powder container unit 31 is detachably attached to the powder supplying device body 21. Specifically, a set of rollers 31a are provided on the bottom of the powder container unit 31, and a gripping part 55 is provided on the top of the powder container unit 31. And an operator, such as a user or a serviceman, will move the powder container unit 31 on a floor using the rollers 31*a* (in the direction indicated by the white arrow in FIG. 3), while holding the gripping part 55. In the powder supplying device body 21, a door 21*b* having a handle 21*a* is provided (see FIG. 5). The door 21*b* is opened or closed by the operator, so that attachment or detachment of the powder container unit 31 to the powder supplying device body 21 is performed. At this time, the connection or disconnection of connection terminals 50, 53*a*-53*c* and 57 on the side of powder container unit 31, and connection terminals 51, 54*a*-54*c* and 58 on the side of powder supplying device body 21 is performed (see FIG. 4).

In this embodiment, the casters 31*a* are installed, as shown in FIG. 3 and FIG. 6, in the vicinity of the uppermost positions of the slope (the V-shaped portion) of the powder container unit 31, and the height of the powder container unit 31 including the casters 31*a* can be made comparatively low.

The powder supplying device 20 in this embodiment is provided so that the powder container unit 31 containing toner can be detached from the powder supplying device body 21 and can be moved to another position. When the toner in the powder container unit 31 becomes empty mostly, the used powder container unit 31 can be replaced with a new powder container unit 31 which is filled with toner. If the changing work is performed, toner from the new powder container unit 31 can be continuously supplied to the image forming device 1. Since the powder supplying device 20 has a power supplying part 60 which is formed separately from the power source of the image forming device 1, the powder container unit 31 can be exchanged without turning off the image forming device 1. Thus, the powder container unit 31 can be exchanged without causing the inoperative time of the image forming device 1.

As shown in FIG. 4, the elements provided in the powder supplying device body 21 include the pump 22 (diaphragm type air pump) which attracts the toner T contained in the powder container unit 31 and transports the toner to the powder receiving device (toner hopper 9), the air pump 24 which supplies air to the gas blowing part 33, and the power supplying part 60.

In this embodiment, the powder receiving device to which the toner from the powder supplying device 20 is supplied is the toner hopper 9 of the image forming device 1. Alternatively, the powder receiving device may be made into the toner replenishing part 5*a* of the developing unit 5 in the image forming device 1.

As shown in FIG. 6, the elements provided in the powder container unit 31 include the suction tube 37, the gas blowing parts 33A, 33B, and 33C1 to 33C4, the four flexible tubes 40, 44*a*-44*c* (made of silicone rubber), the second gas blowing part 62, the holding member 65 (which holds the second gas blowing part 62 and the suction tube 37), the remaining toner sensor 38 (near end sensor) (which is a detection unit detecting a remaining toner in the powder container unit 31), the cable 47 (harness line) (which is electrically connected to the remaining toner sensor 38), and the column 61 (which supports the remaining toner sensor 38, the holding member 65 and the cable 47). In the powder container unit 31, the toner T which is a kind of powder is contained, and the volume average particle diameter of the toner T is in a range of 3-15 micrometers.

The bottom of the powder container unit 31 is formed into a sloping surface which is inclined so that a lowest position of the sloping surface is around a center of the sloping surface. In other words, the vertical cross-section of the bottom of the powder container unit 31 is formed in the shape of a V character. And gas blowing parts 33A, 33B and 33C1 to 33C4 are disposed on the bottom of powder container unit 31 which is formed into the sloping surface.

The sloping surface of the bottom of the powder container unit 31 is set to have an angle of gradient smaller than a limit angle (which is an angle of gradient when the toner starts slipping down) with respect to the toner T contained in the powder container unit 31. Specifically, the angle of gradient of the sloping surface is set to be about 20 degrees whereas the limit angle of the toner T is about 40 degrees. Since the angle of gradient of the sloping surface is set to be sufficiently small, it is possible to make the dead space due to the slope small, prevent the toner from depositing only at the lowest position of the sloping surface, and prevent the bulk density of the toner at the lowest position from becoming excessively high.

The gas blowing parts in this embodiment include a relay part 33A, a porous material 33B, four chambers 33C1 to 33C4, etc. The gas blowing parts serve to eject air (gas) to the inside of the powder container unit 31. The lateral cross section of the gas blowing parts (which cross section is perpendicular to the air flowing direction) is formed generally in the shape of a rectangle. The porous material 33B of the gas blowing part (fluid membrane) is disposed on the bottom base which is directly in contact with the toner T in the powder container unit 31. The air sent out from the air pump 24 of the powder supplying device body 21 is sent to the porous material 33B through the tubes 44*a* and 44*b* and the chambers 33C1 to 33C4, and the porous material 33B serves as a gas discharge opening from which air is discharged into the inside of the powder container unit 31.

The porous material 33B in this embodiment contains fine porous material particles which let air pass through. The porous material 33B is formed so that the open area ratio is in a range of 5 to 40% (which is preferably in a range of 10 to 20%), and the average opening diameter is in a range of 0.3-20 micrometers (which is preferably in a range of 5-15 micrometers). The porous material 33B is formed so that the ratio of the average hole diameter of the holes of the porous material to the volume average particle diameter of the toner is in a range of 0.1 to 5 times (which is preferably in a range of 0.5 to 3 times).

Examples of the porous material 33B in this embodiment may include glass, a sintered body of resin particles, a porous resin material, such as a photo-etched resin or a thermally punched resin, a sintered metal body, a punched sheet metal body, a net laminated body, and a metallic material having selectively fused holes which are formed by heating a copper plate, which is produced so that metal copper is deposited around easily melting metallic yarns and the easily melting metallic yarns are embedded through the copper plate through an electrochemical process, such that the easily melting metallic yarns are removed selectively.

By ejecting air towards the toner T in the powder container unit 31 through the porous material 33B, the bulk density of the toner can be reduced constantly, and the toner can be mobilized, thereby preventing bridge formation of the toner. The weight per toner particle is small enough and the air pressure applied to the porous material 33B is high enough. Even if the toner enters the hole parts of the porous material 33B, the toner will not enter the chamber, thereby preventing the hole parts of the porous material 33B from being clogged by the toner.

The chamber which is disposed under the porous material 33B includes the four chambers 33C1 to 33C4 which are provided independently of each other. The first chamber 33C1 and the second chamber 33C2 are adjacent to the relay part 33A which is disposed at the lowest position of the powder container bottom (sloping surface). The air from the air pump 24 after it is branched at the relay part 33A via the connection terminals 53*b* and 54*b* and the second tube 44*b* is sent out to the first chamber 33C1 from the ejection opening 44*b*1. The air from the air pump 24 after it is branched at the relay part 33A via the connection terminals 53*b* and 54*b* and the second tube 44*b* is sent out to the second chamber 33C2 from the ejection opening 44*b*2. The air which is discharged to the first chamber 33C1 and the second chamber 33C2 is further discharged to the vicinity of the lowest position of the powder container bottom (sloping surface) through the porous material 33B.

The third chamber 33C3 and the fourth chamber 33C4 are adjacent to the first chamber. 33C1 and the second chamber 33C2, respectively. The air from the air pump 24 after it is branched at the relay part 33A through the connection terminals 53*a* and 54*a* and the first tube 44*a* is sent out to the third chamber 33C3 from the ejection opening 44*a*1. The air from the air pump 24 after it is branched at the relay part 33A through the connection terminals 53*a* and 54*a* and the first tube 44*a* is sent out to the fourth chamber 33C4 from the ejection opening 44*a*2. The air which is discharged to the third chamber 33C3 and the fourth chamber 33C4 is further discharged through the porous material 33B to other positions different than the vicinity of the lowest position of the powder container bottom (sloping surface).

The area of the first chamber 33C1 and the second chamber 33C2 (which is the area of the contact surface which touches the porous material 33B) or the volume of the first chamber 33C1 and the second chamber 33C2 is set up to be smaller than the area or the volume of the third chamber 33C3 and the fourth chamber 33C4.

The gas blowing part in this embodiment is thus constituted. The gas blowing part is provided so that a flow rate of gas per unit area in the vicinity of the lowest position of the sloping surface (or the position where the first chamber 33C1 and the second chamber 33C2 are disposed) is larger than a flow rate of gas per unit area in other positions of the sloping surface (or the positions where the third chamber 33C3 and the fourth chamber 33C4 are disposed).

It is likely that the bulk density of the toner in the vicinity of the lowest position of the sloping surface is higher than that at other positions of the sloping surface (which are upper positions including the uppermost position). Thus, a difference in the flow rate of gas is provided for the gas blowing part in this embodiment depending on the position of the sloping surface, and it is possible to equalize the fluidity of the toner in the whole sloping surface efficiently.

Thus, the gas blowing part including the plurality of chambers (the first chamber 33C1, the second chamber 33C2, the third chamber 33C3 and the fourth chamber 33C4) is provided in this embodiment, and gas from the air pump 24 is independently fed into the respective chambers, and a difference in the gas flow rate is provided depending on the position of the sloping surface. The difference in the gas flow rate is provided with the difference in the area (area or volume of chamber 33C1 to 33C4) of the gas blowing part for blowing off gas.

Alternatively, in order to provide the difference in the gas flow rate, the method of installing porous members (each with a different hole size or a different number of pores) at different positions where it is desired to providing a difference in the gas flow rate may be used, or the method of controlling the pressure air sent from the air pump 24 to be different may be used.

In order to ensure the above-mentioned effect, it is preferred to set up that the flow rate of gas per unit area in the vicinity of the lowest position of the sloping surface (where the first chamber 33C1 and the second chamber 33C2 are arranged) is 1.1 to 2 times as large as the flow rate of gas per unit area in the other positions (where the third chamber 33C3 and the fourth chamber 33C4 are arranged).

In order to efficiently attract the toner T even when the amount of the remaining toner T in the powder container unit 31 decreases, the suction tube 37 (suction opening) is arranged above the relay part 33A (the lowest position of the sloping surface).

As shown in FIG. 2, the suction tube 37 is arranged in the vicinity of the side wall (which is the side wall on the left-hand side of FIG. 2) of the powder container unit 31. Thereby the toner in the powder container unit 31 can be efficiently attracted by the suction tube 37 with a minimized waste, which does not form a deviation of the toner in the powder container unit 31. This will be explained later using FIG. 10 and FIG. 11.

As shown in FIGS. 2-6, the suction tube 37 is connected to one end (suction opening) of the pump 22 through the suction tube 40 and the connection terminals 50 and 51 (relay tube). The other end (ejection opening) of the pump 22 is connected to the toner hopper 9 of the image forming device body through the discharge tube 41. Namely, the powder discharge path from the powder container unit 31 to the pump 22 is formed with the suction tube 37, the suction tube 40, and the connection terminals 50 and 51, while the powder discharge path from the pump 22 to the toner hopper 9 is formed with the discharge tube 41. When the pump 22 works, the toner T in the powder container unit 31 is attracted from the suction opening 37*a* of the suction tube 37, and the toner is transported to the toner hopper 9 (toner receiving device) through the pump 22.

Since the suction tube 40 and the discharge tube 41 in this embodiment are made of a silicone rubber with a low toner affinity, it is possible to avoid the problem that the toner adheres to the tube inside and the toner transport characteristic falls. Since some or all of the powder suction path and the powder discharge path are formed by the flexible tubes 40 and 41, the degree of freedom of the layout of the powder container unit 31, the pump 22, and the toner hopper 9 can be increased.

As shown in FIG. 2, the pump 22 is arranged in the upper position above the toner hopper 9 which is a toner receiving device. The toner T attracted by the pump 22 is discharged to the toner hopper 9 arranged in the lower position. Therefore, because of the height difference between the pump 22 and the toner hopper 9, the toner can be certainly transported with a small discharge force, even when the distance from the pump 22 to the toner hopper 9 is comparatively large.

It is preferred that the powder discharge path which is formed by the discharge tube 41 is arranged so that the angle of gradient θ of the powder discharge path is in a range of 20-90 degrees (more preferably, in a range of 25-45 degrees). In addition to the discharge force of pump 22, the gravity force is exerted on the toner in the vertical direction efficiently so that the toner is moved along the powder discharge path.

The suction tube 37 (suction opening 37*a*) of the powder suction path is disposed below the pump 22. That is, the toner T in the powder container unit 31 is attracted upwards from the suction tube 37 (the inside diameter of which is in a range of 6-8 mm) which is disposed near the lowest location of the powder container unit 31. Therefore, the toner T in the powder container unit 31 can be attracted and transported efficiently.

Even when the suction tube 40 is damaged or disconnected, it is possible to avoid the situation that a large amount of the toner in the powder container unit 31 disperses. In such a case, only a small amount of the toner which has passed along the inside of the suction tube 40 disperses.

In this embodiment, a distance H1 in the vertical direction between the suction opening 37*a* of the suction tube 37 and the pump 22 is set up to be 1.5 to 2 times as large as a distance H2 in the vertical direction between the toner hopper 9 and the pump 22. Thereby, the balance of the whole transporting line from the suction opening 37*a* of the suction tube 37 to the toner hopper 9 through the pump 22 can be maintained.

In this embodiment, the pump 22 (the powder supplying device body 21) and the powder container unit 31 are arranged outside the image forming device body 1, the powder supplying device 20 can be provided regardless of the layout of the image forming device body 1. For example, regardless of the height of the image forming device body 1, the pump 22 can be arranged in a still higher position. In addition, the image forming device body 1 may be arranged in an office, and the powder supplying device 20 which may become dirty with the toner may be installed outside the office.

Figure 7:
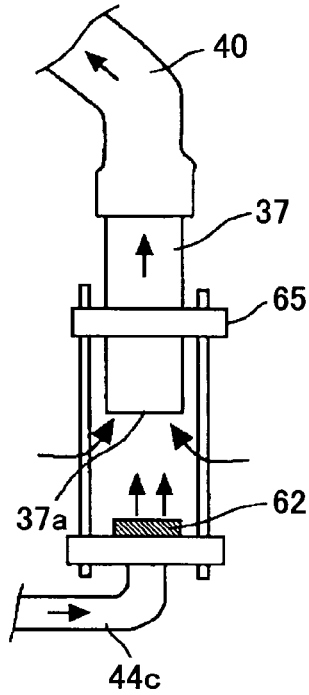
FIG. 7 is an enlarged diagram showing a portion of the powder supplying device in the vicinity of a suction tube.

As shown in FIG. 7, the suction tube 37 is fixed to the holding member 65 which is supported by the column 61. Under the suction tube 37, the second air blowing part 62 which is held by the holding member 65 is arranged. The holding member 65 (and the column 61) is provided to set up the position of the second air blowing part 62 to the suction tube 37 and set up the position of the suction tube 37 in the powder container unit 31.

The second air blowing part 62 is provided to blow off the air sent from the air pump 24 through the connection terminals 53*c* and 54*c* and the third tube 44*c*, directly to the suction opening 37*a* of the suction tube 37 (and to the vicinity of the remaining toner sensor 38. The second air blowing part 62 is formed by the porous member (which may be provided with a chamber). The porous member of the second air blowing part 62 is made of a material that is the same as the material of the porous member 33B of the gas blowing part mentioned above. Thereby, the bulk density of the toner in the vicinity of the suction opening 37*a* of the suction tube 37 falls and the toner is mobilized, so that the toner transport characteristic improves without causing the sticking of the toner in the transporting units 22, 37, 40 and 41. And the toner in the vicinity of the remaining toner sensor 38 is mobilized, and the detection performance of the remaining toner sensor 38 is stabilized.

In this embodiment, air is blown off to the vicinity of the remaining toner sensor 38 and the vicinity of the suction opening 37*a* of the suction tube 37 by using the second air blowing part 62. Alternatively, the air blowing part which blows off air to the vicinity of the suction opening 37*a* of the suction tube 37, and the air blowing part which blows off air to the vicinity of the remaining toner sensor 38 may be provided independently of each other.

Alternatively, the second air blowing part 62 may be formed integrally with the air blowing part provided in the bottom of the powder container unit 31.

Figure 8:
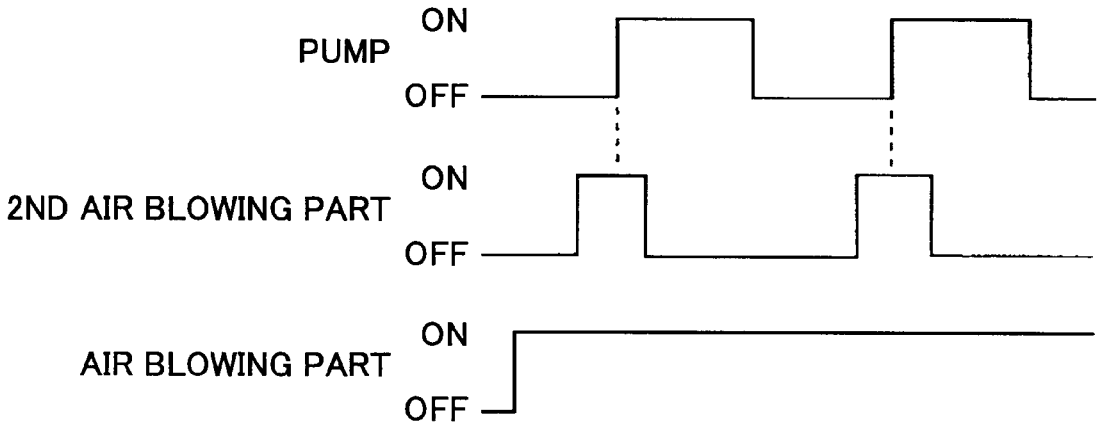
FIG. 8 is a timing chart for explaining a control of a second air blowing part.

As shown in the timing chart of FIG. 8, the powder supplying device 20 in this embodiment is controlled so that, before the suction (or the suction from the suction tube 37) by the pump 22 is started, operation of the second air blowing part 62 (blowing air to the suction opening 37*a*) is started. Thereby, fluidization of the toner is certainly promoted by the second air blowing part 62 when the toner is attracted from the suction tube 37, and the toner transport can be performed smoothly by the transporting units 22, 37, 40, and 41.

Moreover, the powder supplying device 20 in this embodiment is controlled so that, before the suction (or the suction from the suction tube 37) by the pump 22 is terminated, operation of the second air blowing part 62 (blowing air to the suction opening 37*a*) is terminated. This is because the fluidity of the toner improves by the second blowing part 61 immediately before the suction of the toner from the suction tube 37 is started, and the toner transport by the transporting units 22, 37, 40, and 41 is performed smoothly. It is no longer necessary to continue the operation of the second air blowing part 62 at that time. Therefore, in this embodiment, in order to reduce the duty ratio of the second air blowing part 62, after a fixed time passes from the start of the operation of the pump 22, the operation of the second air blowing part 62 is stopped.

As shown in FIG. 8, operation of the air blowing parts 33A, 33B and 33C1 to 33C4 (fluid membrane) is performed independently of the operation of the second air blowing part 62. Operation of the gas blowing parts 33A, 33B and 33C1 to 33C4 may be performed continuously or intermittently. It may be performed according to the degree of lowering of the toner fluidity in the powder container unit 31 periodically for every period of a fixed time.

In addition, it may be controlled so that the timing of the gas blowing part to blow air to the first chamber 33C1 and the second chamber 33C2 and the timing of the gas blowing part to air to the third chamber 33C3 and the fourth chamber 33C4 are shifted from each other, so that the fluidity of the toner in the whole powder container unit 31 can be equalized efficiently.

Alternatively, the operation of the second air blowing part 62 may be interlocked with switching on and off of the pump 22. By performing such control, the toner transport characteristic can be increased with a comparatively simple control and the scattering of the toner in the toner receiving device can be avoided.

The second air blowing part 62 may be intermittently operated during operation of the pump 22. By performing such control, when the pump 22 works continuously over a long time, the toner transport characteristic can be raised. And when the operation of the pump 22 is not performed for a long time, the second air blowing part 62 may be worked intermittently. By performing such control, even if the operation of the pump 22 is started after a long time, the toner transporting can be performed smoothly.

Alternatively, the operation of the second air blowing part 62 may be started compulsorily only for a fixed time after the main switch of the image forming device body 1 is turned on. By performing such control, in conformity with the time of the warming up of the image forming device body 1, the warming up of the powder supplying device 20 is performed, and the toner transporting can be smoothly performed immediately after the operation is initiated.

In this embodiment, air is independently blown off to the third chamber 33C3 and the fourth chamber 33C4, the first chamber 33C1 and the second chamber 33C2, and the second air blowing part 62, respectively, by using the three tubes 44*a*-44*c*. It is possible to easily perform the control of adjustment of the air gas flow rate or air pressure to be in conformity with the respective functions.

As shown in FIG. 5 and FIG. 6, an opening and a filter 35 which covers the opening are provided in the top surface of the powder container 31. The filter 35 serves to prevent the internal pressure in the powder container 31 from rising, and prevent the toner in the powder container 31 from leaking out of the powder container 31. The material of the filter 35 may be the same as the porous material 33B mentioned above. Alternatively, "Gore-Tex" (the registered trademark, the Japan Gore-Tex product) which is a continuation porous-structure substance made of fluoro-resin may also be used as material of the filter 35. If the filter 35 is disposed above from the upper limit line of the toner when the powder container 31 is completely filled with the toner, the filter 36 may be disposed at any location other than the top surface of the powder container 31 (for example, a side surface).

Figure 9:
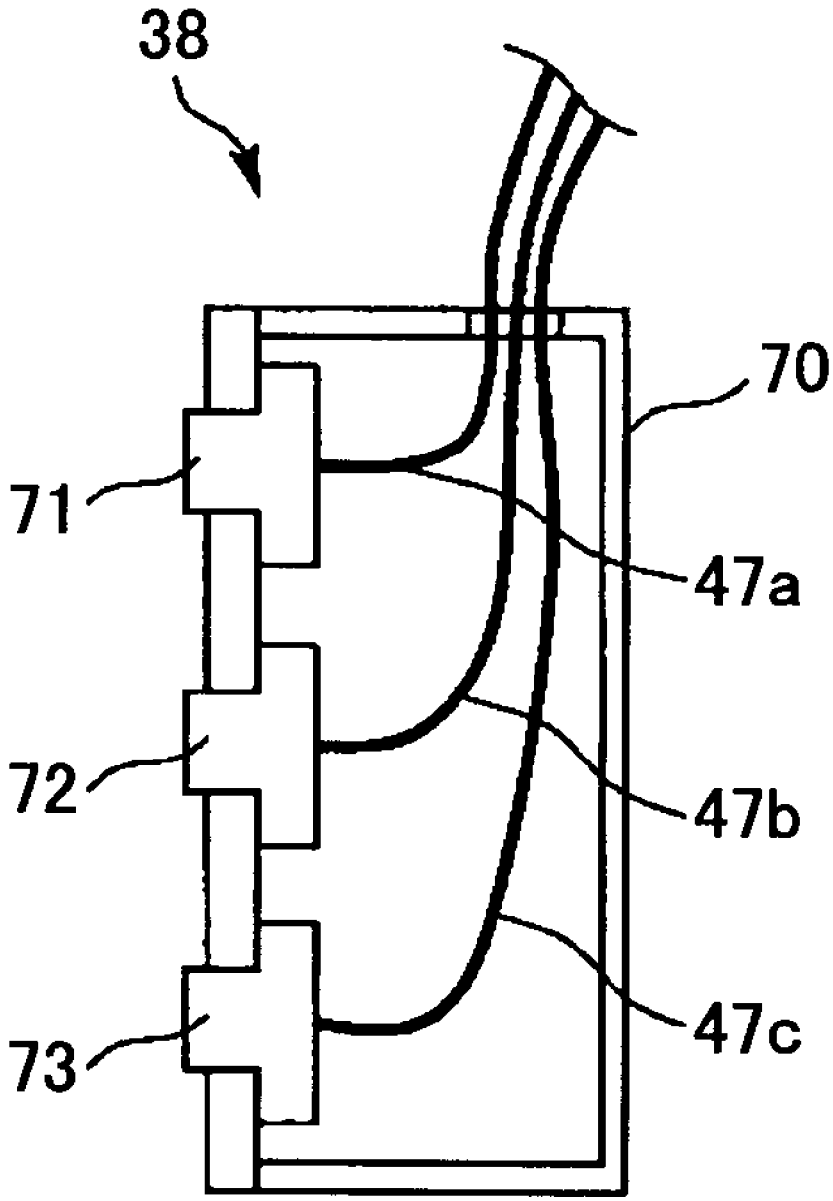
FIG. 9 is a cross-sectional diagram showing a remaining toner sensor.

As shown in FIG. 9, the remaining toner sensor 38 includes three piezoelectric sensors 71-73 which are disposed side by side at separate locations in the perpendicular direction. These piezoelectric sensors 71-73 are held in the case 70 which is supported by the column 61. Three cables 47*a*-47*c* are electrically connected to the three piezoelectric sensors 71-73 respectively, and they are bundled together within the case 70. The cables 47 are supported by the column, and electrically connected through the connection terminals 57 and 58 (connectors) and the cable 48 to the control unit of the image forming device 1.

The remaining toner sensor 38 in this embodiment is provided so that the remaining toner in the powder container 31 is classified into three quantity levels and the respective quantity levels of the remaining toner are notified to a user. Specifically, when the piezoelectric sensor 71 disposed at the upper location of the remaining toner sensor 38 detects that no toner remains in that location (height) of the sensor 71, a message indicating that the quantity of the remaining toner in the powder container 31 has decreased to the pre-near-end quantity level is displayed on the display screen of the image forming device 1 (warning indication of pre-near-end condition). Subsequently, when the piezoelectric sensor 72 disposed at the intermediate location of the remaining toner sensor 38 detects that no toner remains in that location (height) of the sensor 72, a message indicating that the quantity of the remaining toner in the powder container 31 has decreased to the near-end quantity level is displayed on the display screen of the image forming device 1 (warning indication of near-end condition). Finally, when the piezoelectric sensor 73 disposed at the lower location of the remaining toner sensor 38 that no toner remains in that location (height) of the sensor 73, a message indicating that the quantity of the remaining toner in the powder container 31 has decreased to the toner-end quantity level is displayed on the display screen of the image forming device 1 (warning indication of toner end). Concurrently with the warning indication of toner end, the pump 22 is controlled to stop the toner attraction operation until the exchange work of the powder container 31 is completed.

The remaining toner sensor 38 which constitutes the detection unit is disposed outside the suction tube 37, and it is possible to prevent the problem that the toner in the suction tuber 37 turns into a block of toner clogging the suction tube 37. The remaining toner sensor 38 is disposed above the suction opening of the suction tube 37, and it is possible to prevent the problem that only air is attracted from the suction tube 37. Namely, using the remaining toner sensor 38, the toner-end signal is transmitted to the control unit when the toner still remains in the upper location of the suction opening, and the pump 22 is controlled to stop the toner attraction operation. This prevents the problem that only air is attracted from the suction tube 37 (or air is attracted in a condition that the mixture ratio of the toner to air is very small).

Since the remaining toner sensor 38 is disposed above the gas blowing part 33, it is possible to raise the detecting accuracy of the remaining toner in the powder container. That is, the toner mobilized by the gas blowing part 33 is sensed by the remaining toner sensor 38, and the quantity of the remaining toner can be stably detected with good accuracy. Since the remaining toner sensor 38 is disposed above the lowest location of the gas blowing part 33 (sloping surface), it is possible to detect correctly the quantity of the remaining toner in the powder container 31 which is attracted efficiently and economically by the suction tube 37 similarly disposed above the lowest location.

The location of the above-mentioned remaining toner sensor 38 in the powder container 31 is set up accurately by the column 61 and the holder 70. In addition, as mentioned above, the second gas blowing part 62 is disposed under the remaining toner sensor 38. Thus, the toner in the vicinity of the remaining toner sensor 38 is mobilized, and the detection accuracy of the remaining toner sensor 38 is stabilized.

Figure 10A:
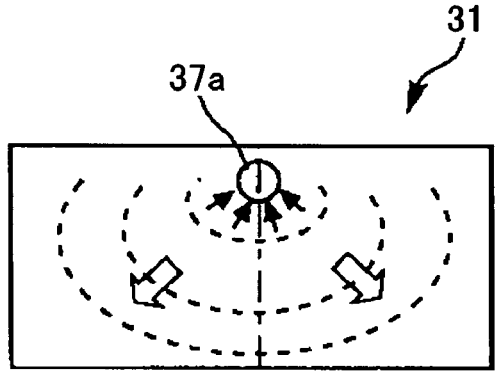
FIG. 10A and FIG. 10B are diagrams showing the condition in which powder is attracted by a suction tube in the powder supplying device of this embodiment.
Figure 10B:
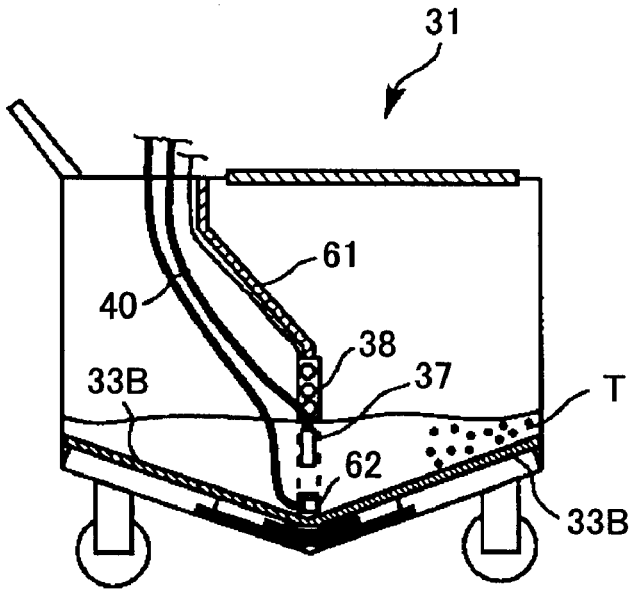

FIG. 10A is a top view showing the vicinity of the suction opening 37*a* of the suction tube 37 in the powder container unit 31 of this embodiment. FIG. 10B is a side view showing the inside of the powder container unit 31.

As shown in FIG. 10A, the suction tube 37 is arranged in the vicinity of the side wall (or the upper side wall in FIG. 10A) of the powder container unit 31. The suction tube 37 is arranged in the vicinity of the side wall of the powder container unit 31 rather than in the center of the powder container unit 31, and the range in which the toner T is attracted from the suction opening 37*a* is regulated. Specifically, the suction of toner from the center of the powder container unit 31 is performed positively by the suction opening 37*a* as indicated by the black arrows in FIG. 10A, and the suction of toner from the side wall (or the upper side wall in FIG. 10A) of the powder container unit 31 is not performed positively.

In the case of the powder container unit 31 containing a sufficiently large amount of toner therein, the toner flowing region (or the regions indicated by the dotted lines in FIG. 10A) spreads in the directions indicated by the white arrows in FIG. 10A according to the consumption of the toner.

More specifically, if the consumption of the toner (the suction of toner from the suction tube 37) is started in the powder container unit 31 in which the toner is fully contained, the toner in the vicinity of the circumference of the suction tube 37 (or the circumference except the side wall) is first mobilized, and the mobilized toner is attracted from the suction opening 37*a* with air. Air in the toner flowing region in the vicinity of the suction opening 37*a* is likely to escape according to the consumption of the toner, the surrounding toner collapses, and the toner flowing region gradually spreads towards the outside (or in the directions indicated by the white arrows in FIG. 10A).

Eventually, as shown in FIG. 10B, the toner in the powder container unit 31 will be consumed uniformly and a toner end will take place without forming a deviation of the toner in the powder container unit 31.

Figure 11A:
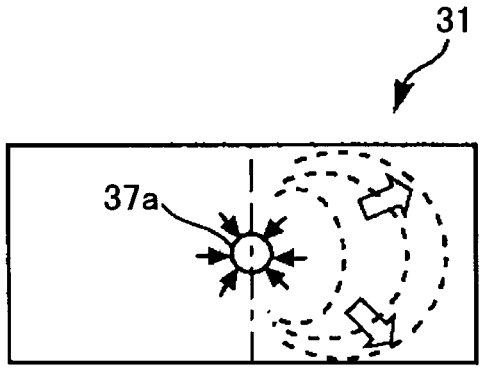
FIG. 11A and FIG. 11B are diagrams showing the condition in which powder is attracted by a suction tube arranged in the center of a powder supplying device in the related art.
Figure 11B:
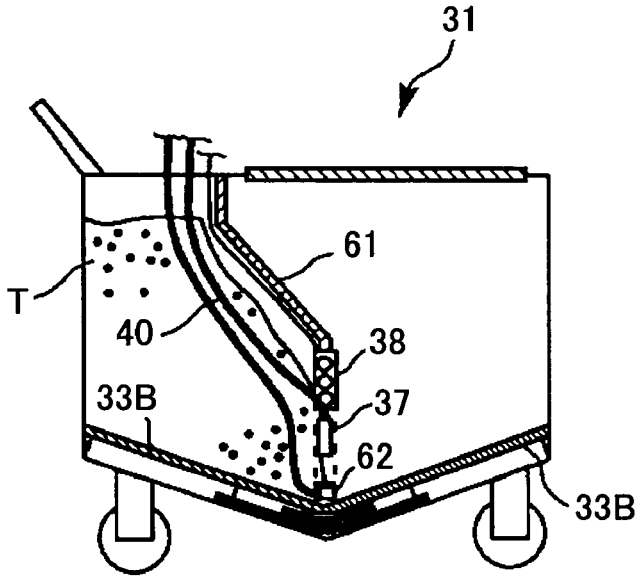

On the other hand, FIG. 11A is a top view showing the vicinity of a suction opening 37*a* of a suction tube 37 arranged in the center of a powder container unit 31 in the related art. FIG. 11B is a side view showing the inside of the powder container unit 31.

If the suction tube 37 is arranged in the center of the powder container unit 31 as shown in FIG. 11A, the suction of toner by the suction opening 37*a* is performed in all the directions towards the center of the powder container unit 31 as indicated by the black arrows in FIG. 11A. In such a case, it is very likely that the suction of toner by the suction opening 37*a* becomes non-uniform for the respective directions due to the condition of the toner contained and the inclination of the suction tube 37.

In the case of the powder container unit 31 of FIG. 11A containing a sufficiently large amount of toner therein, the toner flowing region will spread only in one way according to the consumption of the toner as indicated by the white arrows in FIG. 11A.

More specifically, if the consumption of the toner (the suction of toner from the suction tube 37) is started in the powder container unit 31 of FIG. 11A in which the toner is fully contained, only the toner in the half of the circumference of the suction tube 37 (or the right-hand side in FIG. 11A) is mobilized and the mobilized toner is attracted from the suction opening 37*a* with air. Air in the toner flowing region in the vicinity of the suction opening 37*a* is likely to escape according to the consumption of the toner, the surrounding toner collapses, and the toner flowing region gradually spreads only rightwards (or in the directions indicated by the white arrows in FIG. Finally, as shown in FIG. 11B, a deviation of the toner (or the toner deviating on the left-hand side in FIG. 11B) will be formed in the powder container unit 31, and toner end will take place in this condition. In such a case, a lot of toner remains in the powder container unit 31, and the replacement cycle of the powder container unit 31 will be shortened.

As explained above, in this embodiment, air is blown off from the bottom of the powder container unit 31 by the air blowing part 33, and the suction tube 37 is arranged in the vicinity of the side wall of the powder container unit 31, so that powder is attracted and transported to the toner hopper 9. Without damaging the toner, the frequency of exchange is decreased, supplying of mass toner is attained, fine adjustment of the amount of toner supplied is enabled, no scattering of toner occurs, and toner can be efficiently transported to the toner hopper 9 with a minimized waste.

In the above-mentioned embodiment, the air pump 24 which sends out air to the air blowing parts 33A, 33B and 33C1 to 33C4 and the second air blowing part 62 is arranged in the upper position of the powder container unit 31 in the powder supplying device body 21. Alternatively, the air pump 24 may be arranged in the lower position of the sloping surface of the powder container unit 31 in the powder supplying device body 21. In that case, the air transport passage from the air pump 24 to the air blowing parts 33A, 33B, and 33C1 to 33C4 and the second air blowing part 62 can be shortened. Therefore, a pipe may be used instead of a tube to form the air transport passage.

In the above-mentioned embodiment, the powder supplying device body 21 is separately arranged outside the image forming device body 1. Alternatively, the powder supplying device body 21 may be integrally formed in the image forming device body 1. Namely, in such alternative embodiment, the pump 22, the air pump 24, and the power supplying part 60 may be arranged in the image forming device body 1, and the powder container unit 31 may be configured so that it can be directly detached from or attached to the image forming device body 1.

Figure 12:
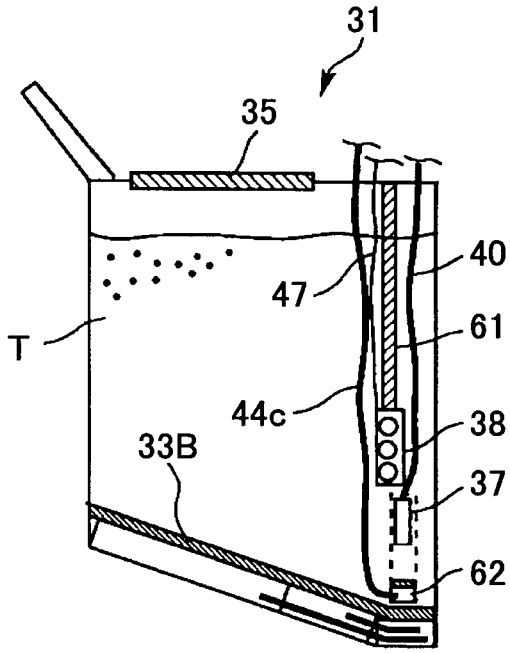
FIG. 12 is a diagram showing a portion of a powder supplying device in an embodiment of the invention.

FIG. 12 shows the composition of a powder container unit of a powder supplying device in an embodiment of the invention.

In the powder supplying device of this embodiment, the composition of the powder container unit 31 differs from that of the previous embodiment. In FIG. 12, illustration of the first tube 44*a*, the second tube 44*b*, and the caster 31*a* is omitted.

As shown in FIG. 12, the powder container unit 31 in this embodiment is constituted so that it includes a suction tube 37, a gas blowing part 33, four tubes 44, a second gas blowing part 62, a remaining toner sensor 38, a cable 47, and a column 61.

In this embodiment, the bottom of the powder container unit 31 is formed into a sloping surface so that one side wall of the powder container unit 31 (or the side wall on the right-hand side of FIG. 12) may serve as the lowest position. The gas blowing part 33 is arranged along the sloping surface in the bottom of the powder container unit 31. The suction tube 37 (suction opening) is arranged above the lowest position (relay part) of the sloping surface.

Also in this embodiment, the suction tube 37 is arranged in the vicinity of the side wall of the powder container unit 31 (or the side wall on the right-hand side of FIG. 12). Thereby, the toner in the powder container unit 31 is efficiently attracted by the suction tube 37 with a minimized waste, without forming a deviation of the toner in the powder container unit 31.

As explained above, in this embodiment, air is blown off from the bottom of the powder container unit 31 by the air blowing part 33, and the suction tube 37 is arranged in the vicinity of the side wall of the powder container unit 31, so that powder is attracted and transported to the toner hopper 9. Without damaging the toner, the frequency of exchange is decreased, supply of mass toner is attained, fine adjustment of the amount of toner supplied is enabled, no scattering of the toner occurs, and the toner can be efficiently transported to the toner hopper 9 with a minimized waste.

Figure 13:
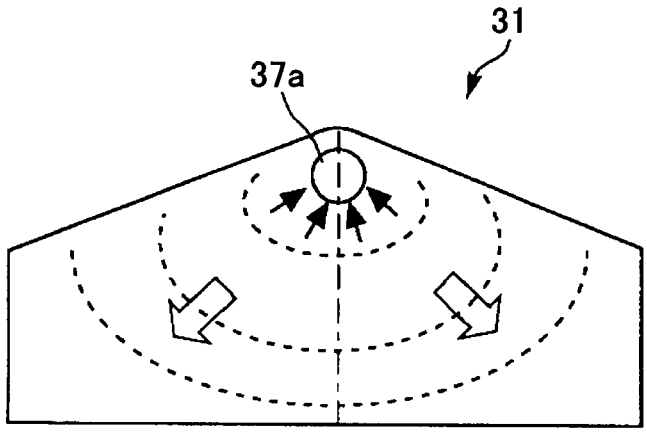
FIG. 13 is a top view of the powder container unit of a powder supplying device in an embodiment of the invention.

FIG. 13 is a top view of the vicinity of a suction opening 37*a* of a powder container unit 31 in an embodiment of the invention, which is equivalent to FIG. 10A.

In the powder supplying device of this embodiment, the composition of the powder container unit 31 differs from that of the previous embodiment.

Similar to the previous embodiment, the powder container unit 31 of this embodiment is constituted so that it includes a suction tube, a gas blowing part, four tubes, a second air blowing part, a remaining toner sensor, a cable, and a column.

Similar to the embodiment of FIG. 10B, the bottom of the powder container unit 31 of this embodiment is formed into a sloping surface so that the vicinity of the center of the powder container unit bottom may serve as the lowest position. The gas blowing part 33 is arranged along the sloping surface in the bottom of the powder container unit 31. The suction tube 37 (suction opening) is arranged above the lowest position (relay part) of the sloping surface.

In this embodiment, as shown in FIG. 13, one side wall of the powder container unit 31 is formed to have a V-shaped horizontal cross section. The suction tube 37 is arranged in the vicinity of the ridge line (or the uppermost ridge line in FIG. 13) of the side wall of the powder container unit 31 having the V-shaped horizontal cross-section.

By such structure, as indicated by the black arrows in FIG. 13, the suction of toner from the center of the powder container unit 31 by the suction opening 37*a* is performed positively, and the suction of toner from the side of the V-shaped cross-sectional side wall of the powder container unit 31 is not performed positively.

In the case of the powder container unit 31 in which the toner is fully contained, the toner flowing region spreads in the directions shown by the white arrows in FIG. 13 according to the consumption of the toner. That is, the toner in the powder container unit 31 is efficiently attracted by the suction tube 37 with a minimized waste, without forming a deviation of a toner in the powder container unit 31.

As described above, in this embodiment, air is blown off from the bottom of the powder container unit 31 by the air blowing part 33, and the powder is attracted and transported to the toner hopper 9 by using the suction tube 37 which is arranged in the vicinity of the side wall of the powder container unit 31. Thus, without damaging the toner, the frequency of exchange is decreased, supply of mass toner is attained, fine adjustment of the amount of toner supplied is enabled, no scattering of the toner occurs, and the toner can be efficiently transported to the toner hopper 9 with a minimized waste.

Figure 14:
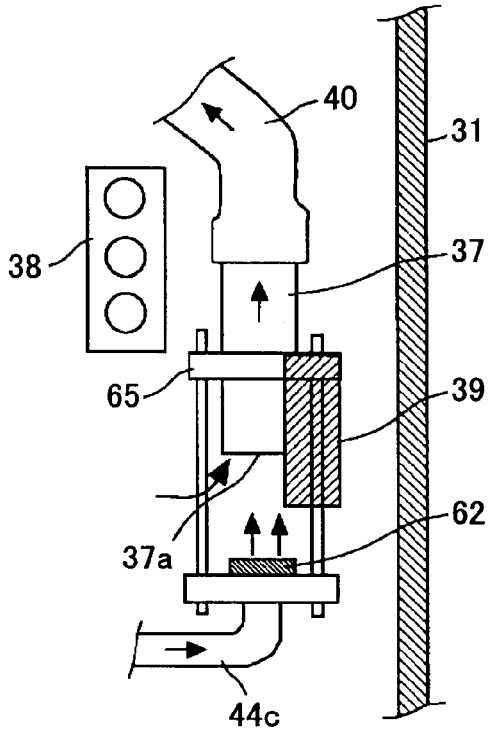
FIG. 14 is a diagram showing the vicinity of a suction tube of a powder supplying device in an embodiment of the invention.
Figure 15:
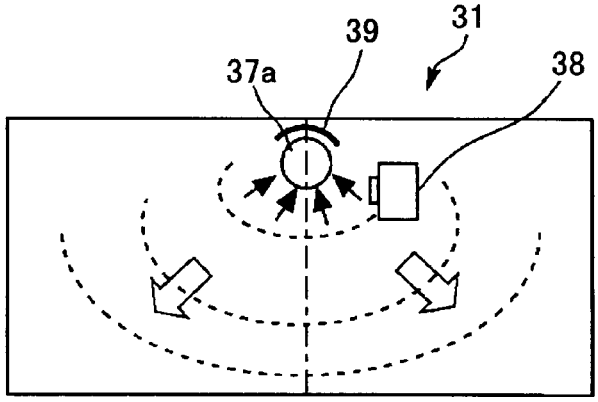
FIG. 15 is a top view of the powder container unit in the powder supplying device of FIG. 14.

FIG. 14 shows the vicinity of a suction tube of a powder supplying device in an embodiment of the invention, which is equivalent to FIG. 7. FIG. 15 is a top view of the vicinity of the suction opening 37*a* of the powder container unit 31, which is equivalent to FIG. 10A.

In the powder supplying device of this embodiment, a regulation part 39 is provided in a vicinity of the suction tube 37, which is different from the previous embodiment.

Similar to the previous embodiment, the powder container unit 31 of this embodiment is constituted so that it includes a suction tube, a gas blowing part, four tubes, a second air blowing part, a remaining toner sensor, a cable, and a column. Also in this embodiment, the suction tube 37 is arranged in the vicinity of the side wall of the powder container unit 31.

In this embodiment, a plate-like member 39 (shading plate) is arranged, and this member 39 forms a regulation part which prevents the toner contained in the powder container unit 31 from being attracted from the side of the side wall of the powder container unit 31 where the suction tube 37 is arranged nearby.

Specifically, the suction tube 37 is fixed to the holding member 65 supported by the column 61 as shown in FIG. 14. Under the suction tube 37, the second air blowing part 62 which is held by the holding member 65 is provided. The suction opening 37*a* of the suction tube 37 is open towards the bottom of the powder container unit 31. The plate-like member 39 is arranged to extend downward over a part of the circumference of the suction tube 37 on the side of the side wall of the powder container unit 31 (or the side wall where the suction tube 37 is arranged nearby).

The plate-like member 39 in this embodiment is made of a thin sheet of Mylar (registered trademark), and the plate-like member 39 is attached to the circumference of the holding member 65 using a double-sided adhesive tape.

By such structure, the suction of toner from the center of the powder container unit 31 by the suction opening 37*a* is performed positively, and the suction of toner from the side of the side wall where the plate-like member 39 is arranged is not performed positively as indicated by the black arrows in FIG. 15.

In the case of the powder container unit 31 in which the toner is fully contained, the toner flowing region spreads in the directions indicated by the white arrows in FIG. 15 according to the consumption of the toner. That is, the toner in the powder container unit 31 is more efficiently attracted by the suction tube 37 with a minimized waste, without forming a deviation of toner in the powder container unit 31.

As shown in FIG. 14 and FIG. 15, the remaining toner sensor 38 which is a detection unit in this embodiment is arranged in the upper position to the suction opening 37*a* and arranged on the side of the suction tube 37 where the plate-like member 39 is not arranged (or on the side of the suction tube 37 where the suction of toner by the suction tube 37 is not regulated by the plate-like member 39).

By such structure, it is possible to effectively prevent the detection accuracy of the remaining toner sensor 38 from being lowered due to the plate-like member 39 being arranged. That is, the remaining toner sensor 38 is arranged in the position where the fluidity of the toner is appropriate, and the detection accuracy of the remaining toner sensor 38 can be maintained at an adequately high level.

In this embodiment, air is blown off from the bottom of the powder container unit 31 by the air blowing part 33, and powder is attracted and transported to the toner hopper 9 by using the suction tube 37 which is arranged in the vicinity of the side wall of the powder container unit 31. Thus, without damaging the toner, the frequency of exchange is decreased, supply of mass toner is attained, fine adjustment of the amount of toner supplied is enabled, no scattering of the toner occurs, and the toner can be efficiently transported to the toner hopper 9 with a minimized waste.

The above-described embodiments are applied to the powder supplying device 20 which supplies a toner to the powder receiving device. Alternatively, this invention may be applied to a powder supplying device which supplies a two-component developer consisting of a toner and a carrier, to the powder receiving device. In such alternative embodiment, a permeability sensor may be used as a detection unit which detects a remaining two-component developer in the powder container.

Moreover, this invention may be applied to the following powder supplying devices:

(1) a powder supplying device (powder supplement device) which supplies a molding material (pellet) to a resin molding machine;

(2) a powder supplying device which transports flour, manure, livestock food, etc;

(3) a powder supplying device used in the manufacture field which supplies powder or liquid chemicals, tablets, etc.;

(4) a powder supplying device which transports cement;

(5) a powder supplying device which transports industrial coating such that the viscosity of the coating is lowered by dispersing air therein;

(6) a powder supplying device which transports industrial glass beads which are used for road paint components, filler materials of air beds, etc.

If the gas blowing part 33 (fluid membrane) is formed with a resin material, such as PE or PC, and a powder with high hardness, such as 2-component developer or glass beads, is used, the gas blowing part 33 will be damaged with time, which will cause clogging of the holes of the porous. Therefore, in such a case, it is preferred that the gas blowing part is formed with a fine-mesh metallic filter made of sintered copper or iron.

In the above embodiment, the diaphragm type air pump is used as the pump 22 which attracts the toner in the powder container unit 31, and the toner is discharged to the toner hopper 9. Alternatively, another pump (for example, a screw pump) may be used instead. Also in such a case, the same effectiveness as the above embodiment can be acquired.

In the above embodiment, the powder supplying device 20 is separately installed outside the image forming device body 1. Alternatively, the powder supplying device 20 may be formed in the image forming device body 1 integrally.

The present invention is not limited to the above-described embodiments, and variations and modifications may be made without departing from the scope of the present invention.

The present application is based on and claims the benefit of priority of Japanese patent application No. 2006-114726, filed on Apr. 18, 2006, the entire contents of which are hereby incorporated by reference.

What is claimed is:

1. A powder supplying device which supplies powder to a powder receiving device, comprising:

a powder container unit containing powder therein;

a gas blowing part arranged in the powder container unit to blow gas to the inside of the powder container unit;

a suction tube having a suction opening and attracting powder contained in the powder container unit from the suction opening, the suction tube being different from the gas blowing part; and a powder transporting unit transporting powder attracted by the suction tube, to the powder receiving device wherein the gas blowing part is arranged to entirely cover a bottom surface of the powder container unit, the suction tube is arranged internal to the powder container unit and entering the powder container unit from a top thereof, the suction tube being closer to a side wall of the powder container unit than a center of the powder container unit, and the suction tube located in a vicinity of the sidewall of the powder container unit.

2. The powder supplying device according to claim 1, wherein the bottom of the powder container unit is formed into a sloping surface and the suction opening of the suction tube is arranged above a lowest position of the sloping surface.

3. The powder supplying device according to claim 2, wherein the gas blowing part is provided so that a flow rate of gas per unit area in a vicinity of the lowest position of the sloping surface is larger than a flow rate of gas per unit area in other positions of the sloping surface than the lowest position.

4. The powder supplying device according to claim 1, further comprising a regulation part which prevents the powder contained in the powder container unit from being attracted from a side of the side wall of the powder container unit where the suction tube is arranged nearby.

5. The powder supplying device according to claim 4, wherein the suction opening of the suction tube is open toward the bottom of the powder container unit, and the regulation part is constituted by a plate-like member which is arranged to extend downward over a part of a circumference of the suction tube on a side of the side wall of the powder container unit.

6. The powder supplying device according to claim 4, wherein the powder container unit is provided with a detection unit which detects a remaining powder in the powder container unit, and the detection unit is arranged in an upper position to the suction opening and arranged on a side of the suction tube where the regulation part is not arranged.

7. The powder supplying device according to claim 1, further comprising a second gas blowing part blowing air directly or indirectly to the suction opening of the suction tube.

8. The powder supplying device according to claim 7, wherein the second gas blowing part has a gas discharge opening which is made of a porous member.

9. The powder supplying device according to claim 1, wherein the powder transporting unit is provided with a pump which attracts powder contained in the powder container unit from the suction opening of the suction tube, and discharges the attracted powder to the powder receiving device.

10. The powder supplying device according to claim 9, wherein the pump is arranged in a position above the powder receiving device and the powder container unit.

11. The powder supplying device according to claim 9, wherein some or all of a powder suction path from the powder container unit to the pump, and some or all of a powder discharge path from the pump to the powder receiving device are constituted by a set of tubes.

12. The powder supplying device according to claim 1, wherein the gas blowing part has a gas discharge opening, and the gas discharge opening is made of a porous member.

13. The powder supplying device according to claim 1, wherein the gas blowing part is connected to an air pump which is arranged outside the powder container unit.

14. The powder supplying device according to claim 1, wherein the powder container unit is provided so that the powder container unit is attachable to and detachable from a body of the powder supplying device.

15. The powder supplying device according to claim 1, wherein the powder contained in the powder container unit is a toner.

16. The powder supplying device according to claim 1, wherein the powder contained in the powder container unit is a two-component developer consisting of a toner and a carrier.

17. An image forming device in which a powder supplying device is provided to supply powder to a powder receiving device, the powder supplying device comprising:

a powder container unit containing powder therein;

a gas blowing part arranged in the powder container unit to blow gas to the inside of the powder container unit;

a suction tube having a suction opening and attracting powder contained in the powder container unit from the suction opening, the suction tube being different from the first gas blowing part; and a powder transporting unit transporting powder attracted by the suction tube, to the powder receiving device wherein the gas blowing part is arranged to entirely cover a bottom surface of the powder container unit, the suction tube is arranged internal to the powder container unit and entering the powder container unit from a top thereof, the suction tube being closer to a side wall of the powder container unit than a center of the powder container unit, and the suction tube located in a vicinity of the sidewall of the powder container unit.

* * * * *